United States Patent [19]

Rabinow

[11] Patent Number: 4,942,749

[45] Date of Patent: Jul. 24, 1990

[54] INTERCHANGEABLE KEY LOCK WITH ROLLING TUMBLERS

[76] Inventor: Jacob Rabinow, 6920 Selkirk Dr., Bethesda, Md. 20817

[21] Appl. No.: 371,114

[22] Filed: Jun. 26, 1989

[51] Int. Cl.[5] ..... E05B 63/00

[52] U.S. Cl. ..... 70/495; 70/383; 70/419

[58] Field of Search ..... 70/383, 337, 338, 339, 70/340, 341, 342, 343, 384, 382, 419–421, 495, 496

[56] References Cited

U.S. PATENT DOCUMENTS

| | | | |
|---|---|---|---|
| 1,136,067 | 4/1915 | Watson | 70/383 |
| 1,693,731 | 12/1928 | Sioberg | 70/383 |
| 2,603,081 | 7/1952 | Pelle | 70/382 |
| 3,774,424 | 11/1973 | Ehrat | 70/383 |
| 3,813,905 | 6/1974 | Sauder | 70/339 |
| 3,837,196 | 9/1974 | Gartner | 70/339 |
| 3,983,728 | 10/1976 | Phillips | 70/339 |
| 4,072,032 | 2/1978 | Phillips | 70/339 |
| 4,372,139 | 2/1983 | Laake | 70/383 |
| 4,376,382 | 3/1983 | Raymond | 70/338 |
| 4,462,230 | 7/1984 | Evans | 70/383 |
| 4,561,269 | 12/1985 | Tanaka | 70/339 |
| 4,712,399 | 12/1987 | Mattossovich | 70/495 |
| 4,729,231 | 3/1988 | Wu | 70/383 |

*Primary Examiner*—Robert L. Wolfe

*Attorney, Agent, or Firm*—William D. Hall

[57] ABSTRACT

This invention describes a lock where each of several tumblers is shaped as a disc and each has gear teeth along parts of its periphery. The teeth mesh with two partial racks that are formed on two side bars. These side bar operate in a manner similar to side bars in many popular locks of to-day. These tumblers are set or re-set into positions by a double bitted key that passes thru a central opening in each tumbler. By rolling the tumblers along the racks on the side bars the lock can be opened or closed. The key can be changed by merely opening the lock with one key and closing it with another.

9 Claims, 3 Drawing Sheets

INTERCHANGEABLE KEY LOCK WITH ROLLING TUMBLERS

BACKGROUND OF THE INVENTION

There are many needs that can be satisfied by a lock which permits easy interchange of keys. This may be necessary for security where money is involved as in vending machines. It may be necessary for households after a burglarly or a change of occupancy. Change in hotel rooms usually require a change of keys, and so on. This subject is well covered in the patent art, particularly in Class 70, sub class 383 in the U.S. Patent Office.

There have been many attempts to design and manufacture locks where the keys can be readily changed. In most of these, particularly designed for safe deposit boxes in banks, two keys are customarily employed. One key is controlled by the bank, and the other is held by the 37 renter." Both keys must be used to open the lock. When the renter terminates his period of rent, or loses a key, or for whatever reason either one or both of the keys have to be changed, the lock is so arranged that after opening the lock with both keys, the renter's key can be easily changed. Or by operating a third key, or by a special tool inserted from the back of the lock, both keys can be changed.

Samples of such locks can be seen in U.S. Pat. Nos. 1,136,067, 4,462,230, 1,693,731, 3,983,728, 3,837,196 and 4,561,269.

There have also been designs where the key can be changed by simply opening the lock with one key and closing it with another. The second key is then necessary to open the lock. An example of this design is in U.S. Pat. No. 4,712,399. A much more complicated mechanism is described in U.S. Pat. No. 3,774,424.

In most of the art cited, the change in mechanism is accomplished by the use of two-part tumblers. The two parts are normally held together by one or two sets of teeth that lock the two parts together. When it is desired to change the key, the two-part tumblers are separated and the parts are shifted relative to each other. Then the parts are recombined and the "new" tumblers are appropriate to the new key.

This is done, for example in U.S. Pat. Nos. 4,712,399 and 3,774,424.

In other designs, lever tumblers are employed where a pivot point is changed for a change in key. For examples see U.S. Pat. Nos. 1,136,067, 4,561,269 and 4,072,032.

All the locks cited above can be criticized for being complex, requiring large cases or very small parts, and in many examples being obviously unreliable due to small sizes of interlocking teeth or single point pivots.

LIST OF DRAWINGS

GENERAL DESCRIPTION OF THE BASIC PRINCIPLES OF THE INVENTION

The lock of the present invention is designed to use simple parts and to fit into a small space. For example it can be fitted into a lock of only ¾ of an inch in outside diameter with the rotating cylinder of only ½ inch. This is a very popular size in widespread use in the United States.

One of the novel features of this lock is that a doublebitted key of the type described in U.S. Pat. No. 4,825,672 issued to me on May 2, 1989, can be used to set, or re-set a number of disc tumblers, as described below.

Figure 1:
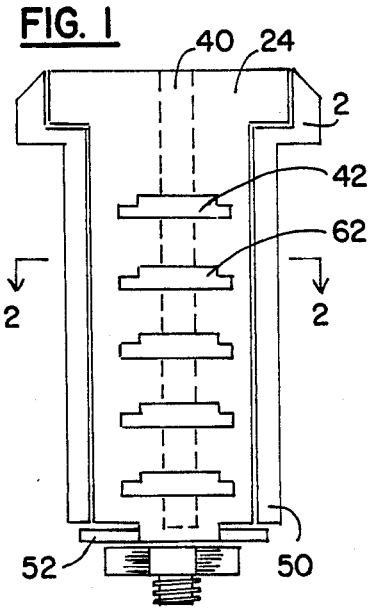
FIG. 1 shows a simplified longitudinal section of my lock.
Figure 2:
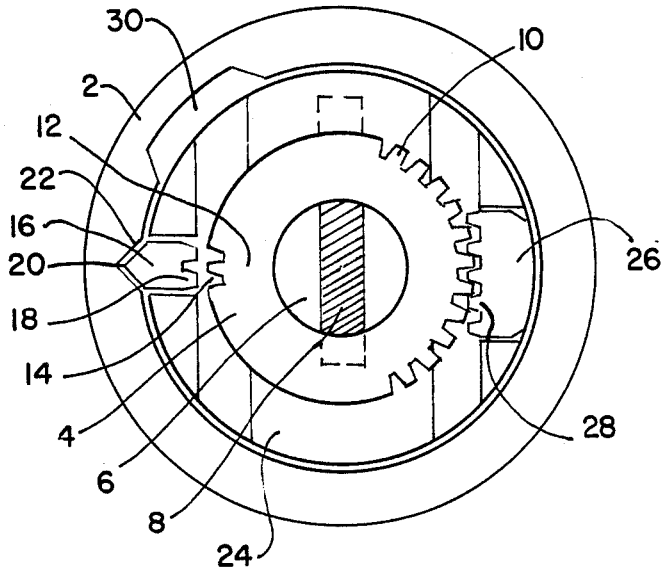
FIG. 2 shows a section of the lock of FIG. 1 taken along line 2—2.
Figure 3:
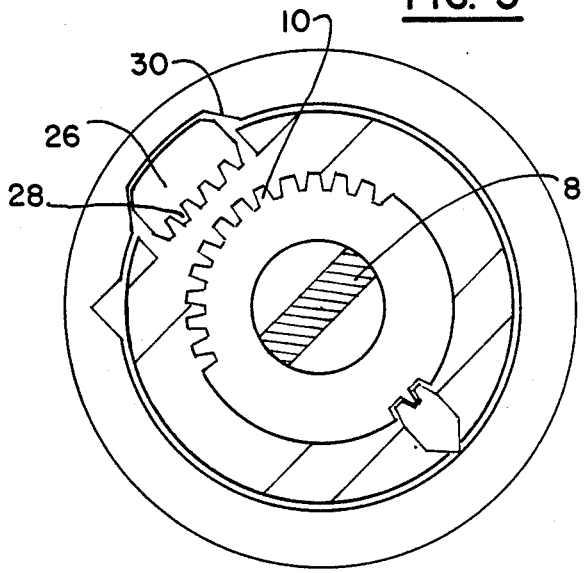
FIG. 3 shows the section of FIG. 2 with the inner cylinder turned thru an angle permitting the key to be changed.

Perhaps the best way to illustrate the basic principles of operation of my lock is to use FIGS. 2 and 3 which show a section taken at right angles to the central axis of the lock of FIG. 1 along line 2—2.

While I shall describe the action with reference to one tumbler, it should be understood that a practical lock would use several such components, for example five or six.

Each tumbler 4 is a disc with a central round hole 6 thru which the key 8 can pass.

Around about half of the circumference of each disc 4 are cut ordinary gear teeth 10. At approximately the mid point 12 of the other half of the circumference there are cut two (for example) gear tooth notches 14 which may be of the same shape and size as the gear teeth 10 on the other side of the disc 4. (They may be of different size, if desired).

The lock is provided with a primary side bar 16 that is similar to side bars used in many simple modern locks except that the inside edge of the side bar 16 is shaped to have two teeth 18 shaped as in a rack to fit the two tooth notches 14 in the disc 4. (I show two teeth by way of example, only). The other edge 20 of the side bar 16 normally rests in a groove 22 in the outer case 2 of the lock and prevents the inner cylinder 24 of the lock from turning unless the tumbler 4 is so positioned by the key 8 that the rack teeth 18 enter the tumbler notches 14 and thus permit the side bar 16 to be cammed out of the groove 22.

The lock is also provided with another rack member 26, similar to a side bar 16 except that it is much wider and is provided with more teeth 28 along its width. These teeth 28 are also shaped to co-act with the teeth 10 occupying approximately half of the periphery of the tumbler 4.

When the key 8 enters the central hole 6 of tumbler 4, the bit of the key 8 (complementary to tumbler 4) causes the tumbler 4 to move vertically upward and, therefore, to roll along side rack 26. If the key 8 is correct it positions the tumbler 4 so that its two notches 14 stop opposite the side bar 16. The side bar 16 can now enter these notches 14 and the lock can be opened.

To change the key, it is only necessary to rotate the cylinder 24 (counter-clockwise in FIG. 2) to a predetermined position (FIG. 3) where the side bar 26 is positioned opposite a wide notch 30 in the outside case 2. The wide rack 26 can now move away from the disc tumbler 4. The original key 8 can now be withdrawn and a new key can now be inserted. The tumbler 4 will roll on the narrow rack 16 and the tumbler 4 will be set for the new key. When the cylinder 24 is now rotated back (clockwise in FIG. 3) the teeth 28 of the side bar 26 will enter the teeth 10 of the tumbler 4, and the lock is now set for the new key.

Additional details of this lock will be described more fully below.

The operation of my lock can be further explained by additional study of FIG. 2 which is a cross-section of the lock taken at right angles to the overall FIG. 1.

A key-slot 40 runs lengthwise thru the lock. A central cylinder 24 is contained within the case 2 and it is this cylinder 24 that must be rotated by a key to open or close the lock. Located in cross slots 42 in the cylinder 24 are a set of circular tumblers 4. Only one is shown in FIG. 2.

Figure 4:
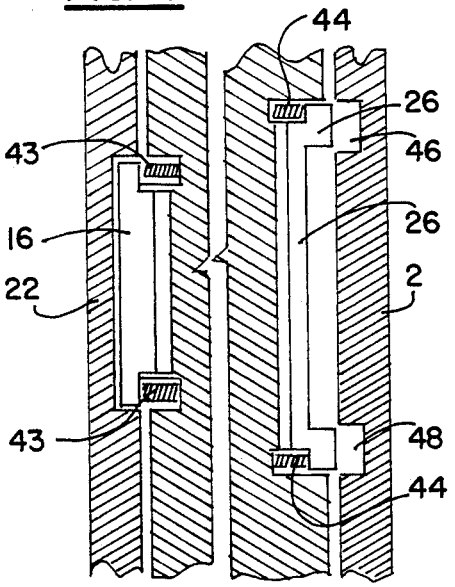
FIG. 4 shows a simplified section of the lock, illustrating the details of the two side bars.

The cylinder 24 is normally kept from rotating by the side bar 16 (see also FIG. 4). This side bar 16 is urged outward by two springs 43 not shown in FIGS. 1 and 2. They are shown in FIG. 4.

The second and wider side bar 26 is shown in the retracted, inner position in FIG. 2. It is also urged outward by two springs 44 not shown in FIG. 2, but which can be seen in FIG. 4.

The two side bars 16 and 26 shown in FIGS. 2, 3, and 4 can be moved outwardly by springs 43 and 44 and can be cammed inwardly by rotation of the cylinder 24. In FIG. 2 I show one notch surface 22 for the narrow side bar 16, and one side notch 30 for the wide side bar 26. I show these notches in FIGS. 2 and 3, as if they are in one plane. This means that the cylidner 24 can be rotated less than 180° to prevent side bar 16 from reaching the side notch 30. While this is satisfactory for some applications, it may be desirable to permit rotation of the cylinder 24 to have nearly 360° of rotational freedom from the lock position shown in FIG. 2 to a position where the key 8 can be changed. I show how this can be accomplished in FIG. 4. Here the notch 22 for the narrow side bar 16 is shorter than the distance between the two notches 46 and 48 formed in the outer case 2 (FIG. 4). Notches 46 and 48 are located at points above and below the notch 22 for the narrow side bar 16. Now the two side bars 16 and 26 are independent from each other, and the cylinder 24 can be rotated nearly 360° before the side bar 26 reaches its notches 46 and 48, permitting the key 8 to be changed.

Figure 5:
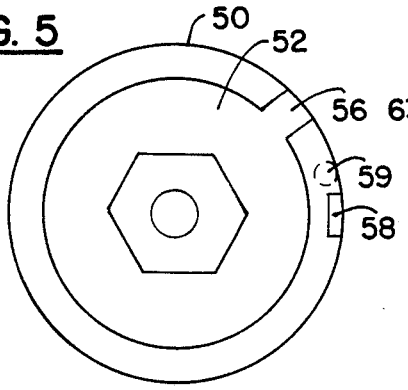
FIG. 5 shows a "bottom" view of the lock illustrating a rotational stop.
Figure 6:
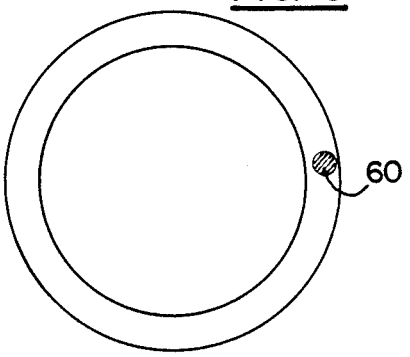
FIG. 6 shows the view of FIG. 5 except that a removable stop is shown.

Rotational stops can be added to this lock to determine the angle where the lock is open and where the key 8 can be changed. The rotational stops can be added to the bottom 50 of the lock as shown in FIGS. 1, 5 and 6. Here a washer 52 is fastened to the bottom of cylinder 24. It has a single protruding lug 56. This lug 56 can abut a projection 58 on the bottom 50 of the case 2. By changing this washer 52 the angle of rotation of the cylinder 24 can be modified.

If it is desired to make the change of key difficult from the front of the lock, the washer 52 or the stop 58 can be modified so that the wide side bar 26 can not be rotated to reach its notch 30. The key then can not be changed. Removing the stop 58 (which may be a screw head) or lowering the washer 52 will then permit the change of the key.

Figure 5A:
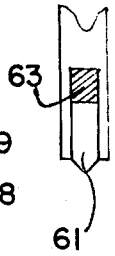
FIG. 5A shows a detail for an optional spring detent to co-operate with lug 56 of FIG. 5.

A detent made of pin 61 and stiff 63 spring (FIG. 5A) can be located just ahead of the stop 58 (at 59) so that considerable torque of the key 8 has to be exerted to rotate the cylinder 24 to the position shown in FIG. 3 so that the key can be changed.

Figure 7:
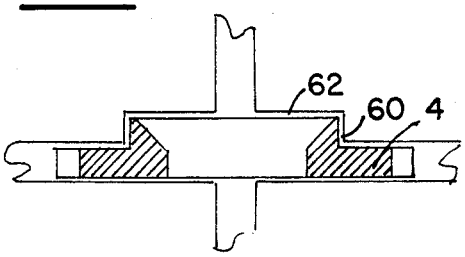
FIG. 7 shows a detailed section of one of the tumblers.

In FIG. 2 I show a simple disc as the tumbler 4. In practice I found it desirable to locate this disc with some accuracy relative to the two sets of rack teeth of side bars 16 and 26. This is accomplished by providing each tumbler disc 4 with vertical guides in the form of a projecting cylindrical surface as seen in FIGS. 7, 8, 9, and 11. This is the reason why the slots 42 in FIG. 1 have the wider portions 62. The cylindrical surface 60 fits into these wider portions 62 and keep the disc tumbler 4 located and guided correctly between rack teeth 18 and 28. FIG. 7 shows in detail the relation of the tumbler 4, the slot 62, and the cylindrical surface 60.

Figure 12:
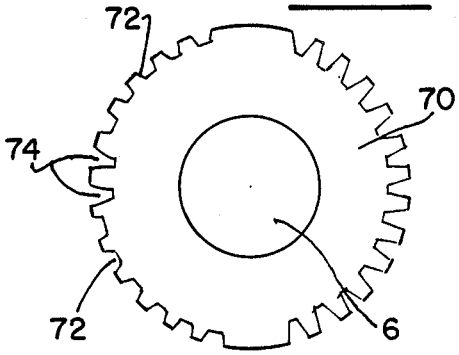
FIG. 12 shows a design of a tumbler to make lock picking more difficult.

In order to make picking this lock more difficult I show a modified disc tumbler 70 in FIG. 12. Here a set of "fake" notches 72 are cut into the disc 70 on both sides of the two real gear notches 74. If someone tries to pick this lock by applying torque to the cylinder 24 while moving the tumbler disc 70, the side bar 16 will be driven into these fake notches 72 and thus prevent the discs 70 from rotating. With five or six such discs it will be very difficult to "feel" where the proper teeth 74 will be engaged by the two rack teeth 18 of the side bar 16.

Figure 8:
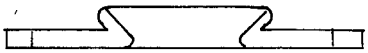
FIG. 8 shows a different construction of a tumbler.

The cylindrical guiding surface such as 60 of the disc 4 can be made in different shapes. For example, it can be made or shown in FIG. 7 where the disc 4 is made by diecasting or by pressed-powder technique. It can also be made by stamping out of sheet metal as shown in FIG. 8. The diecast shape can also be made as in FIG. 11, except that in that case the slots 42, in the cylinder 24 of FIG. 1 would have widened sections 62 on both sides of the slot 42.

Figure 13:
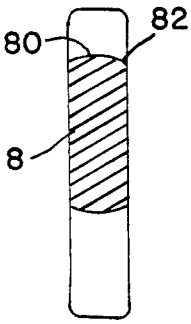
FIG. 13 shows a section of a key to reduce the wear on the key and on the tumblers.

In FIG. 13, I show a cross section of the key 8 with its edges 80 slightly rounded to better fit the circular hole 6 in each of the tumblers 4. This rounding is not absolutely necessary, but may be desirable for long life of the lock. It can be achieved by coining the metal of the key 8. It can also be achieved by tumbling of the keys in proper abrasive environment to cut away the sharp edges 82 of the key, of the key. It the key were die cast, or molded, the edges can be made as round as desired, as in FIG. 13.

Figure 14:
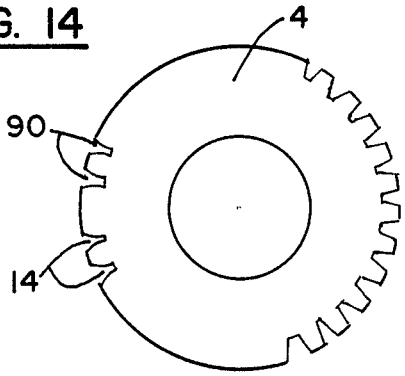
FIG. 14 shows a design of a tumbler to permit the use of master keying.

If a master key is to be used, the periphery of the disc 4 that would normally contain the two tooth notches 14 can be additionally provided with the two other notches 90 located at another location on tumbler 4 as seen in FIG. 14. (Now a second key can be used, and this key can be changed in a manner exactly like that used for the first key).

Figure 10:
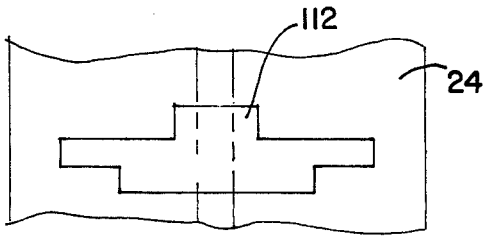
FIG. 10 shows a sectional view of the central cylinder for cooperation the tumbler of FIG. 9.
Figure 9:
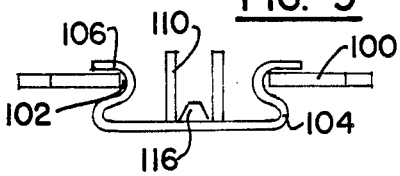
FIG. 9 shows a still different construction of a tumbler with provision for reducing the wear on a tumbler by the inerstion and removal of the key.
Figure 11:
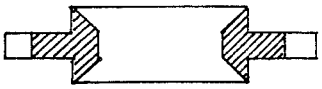
FIG. 11 shows a different design of the tumbler of FIG. 7.
Figure 9A:
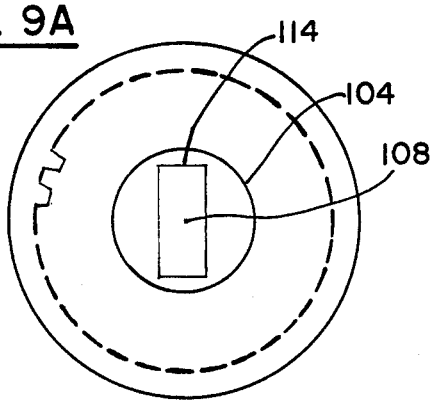
FIG. 9A shows a plan view of the tumbler of FIG. 9.

In application where the lock will be used a great many times, as in a front door of an apartment house, for example, special wear resistant discs 100 can be used. FIG. 9 shows a disc 100 where the key does not contact the central hole 102 directly. A thin metal disc 104 is inserted into the central opening 102 and spun over, or pressed out at 106 so that the disc tumbler 100 is free to rotate about this insert 104. The center of the insert 104 is formed to have a rectangular hole 108 (see FIG. 9A) that fits the bits of the key. This central hole 108 is shaped to provide two side flanges 110 that act to control the position of the tumbler 100 in the cylinder 24 by sliding in the groove 112 shown in FIG. 10. The two smaller edges 114 of FIG. 9A of the insert 104 are provided with flanges 116 (FIG. 9) that ride over the key bits and serve to spread the wear on the insert 104 as the key is inserted into and removed from the lock. If tumblers such as in FIG. 9 are used, the key does not need the rounding of its corners as shown in FIG. 13.

The insert 104 can be made of harder material than the disc 100 and have a more polished surface.

Figure 15:
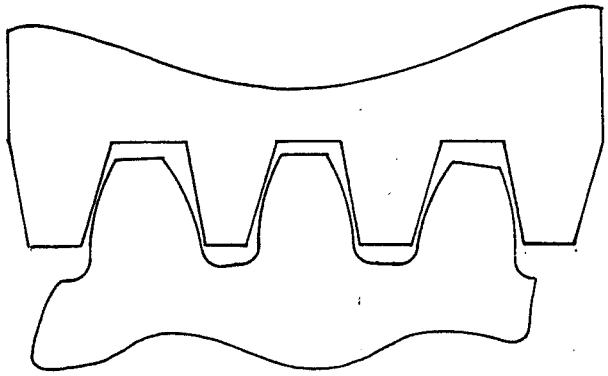
FIG. 15 shows a gear and rack equipped with teeth of conventional shape.
Figure 16:
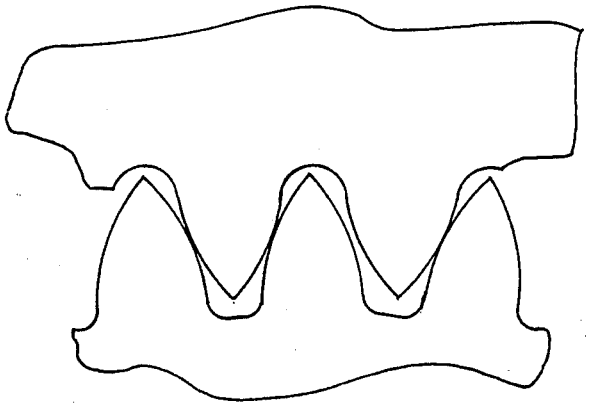
FIG. 16 shows a gear and rack equipped with teeth of modified shape to facilitate meshing of such gears.

In FIGS. 2, 3, 12 and 14 I show conventional gear teeth that have flat tip surfaces. When such teeth are to be moved into radial mesh it may happen that the teeth may clash. This is most likely when the lock mechanism and the key have become worn because of long-time use. In order to minimize the possibility of this interference I can use a modified tooth shape by sharpening the tooth shape both on the racks 16 and 26 and on the tumblers 4. An enlarged view of a set of standard teeth is shown in FIG. 15 and modified teeth are shown in FIG. 16.

One of the great advantages in the manufacture of locks such as described in this specification is that all the locks of this invention can be made exactly alike. If a particular customer orders one or more sets of locks with different keys, only different keys need be supplied with the standard locks to meet the particular specification.

The advantages in manufacture and inventory of the locks is obvious.

I claim to have invented:

1. A lock in which a first key is initially the correct key so that the lock may be opened by the first but not a second key, and wherein after the lock has been opened by the first key the second key may be placed in the lock whereupon the second key becomes the correct key for unlocking the lock and the first key is no longer the correct key and will not unlock the lock, comprising:

a sidebar comprising means for locking and unlocking the lock, tumbler means settable to open the lock by said first key, said sidebar being the lock opening means movable to a lock-opening position when said tumbler means has been set to open the lock by the correct key, and setting changing means for changing, when said sidebar is in said lock open position, the setting of said tumbler means upon the mere insertion of the second key in the lock, so that said second key now becomes the correct key for opening the lock, said tumbler means comprising at least one single piece tumbler, the geometry of each tumbler remaining the same irrespective of the key that is inserted into the lock.

2. A lock as defined in claim 1, in which the keys have at least one bit, and said setting changing means comprising:

a second sidebar, said second sidebar having a set of teeth and said tumbler means having a set of teeth, said sets of teeth mating with each other and comprising means for determining the bitting of the correct key in accordance with the relationship of the teeth on the second sidebar with those on said tumblers means when the lock is open.

3. A lock which may be opened by a key, comprising:

a sidebar that controls the opening or closing of the lock, lock opening tumbler means movable by a first key to open the lock, said tumbler means controlling the position of said sidebar, means responsive to the relative positions of said sidebar and said lock opening tumbler means, when the lock is open, for determining the shape of the correct key and for changing the relative positions of said sidebar and said lock opening tumbler means in response to the insertion of a second key in the lock, while it is open, thereby rendering such second key the correct key for opening the lock and rendering the first key an incorrect key.

4. A lock as defined in claim 3 comprising:

a second sidebar, said second sidebar comprising means determining the shape of the correct key and for changing the relative positions of said first sidebar and said lock opening tumbler means.

5. The lock of claim 1, said tumbler having a set of teeth, and said sidebar having a set of teeth for meshing with the teeth on said tumbler, said two sets of teeth being meshed when the correct key is inserted into the lock, said meshing of the two sets of teeth permitting said sidebar to move from its first position keeping the lock closed to the second position so as to permit the lock to open.

6. A lock having first and second members movable relative to each other to lock and unlock the lock, a first sidebar cooperating with said two members and arranged to prevent said relative movement when the lock is closed, at least one single piece tumbler associated with one of said members and which coacts with said first sidebar to prevent said sidebar from moving so as to prevent the lock from opening, a first and correct key that when inserted into the lock a first and correct key that when inserted into the lock has at least one bit that positions the said tumbler so that this tumbler permits the side bar to move so as to permit the two members to move relative to one another and to permit the lock to open, a second sidebar cooperating with the said tumbler so that only the correct first key an open the lock, means to disengage the second sidebar from the tumbler when the lock is fully open, means to permit the said first key to be withdrawn from the lock and means to permit a second key to be inserted into the lock, and means to change the relation between the said tumbler and said second sidebar so that when the lock is closed by said second key, only the second key can be used to position the tumbler so that it can subsequently permit the first sidebar to enable the lock to open.

7. A lock as defined in claim 6 wherein said first sidebar is positioned in a notch in said first member so that the two members can not move relatively to each other when the lock is closed, said second sidebar being movable relative to said first member with the second sidebar engaged with said tumbler, when the lock is closed, means positioning the tumbler so that when the correct key is inserted into the lock, the tumbler permits the first sidebar to move and permit the lock to open, a second notch in said first member, said second sidebar arranged to enter said second notch in said first member when the lock is open to thereby disengage said second sidebar from the tumbler so that a second key can position the tumbler to open and close the lock.

8. The lock of claim 7, wherein the first and second members are cylindrical and wherein the first member is the outside case and the second member is a cylindrical concentric to and located inside of the first member, said tumbler having teeth, said first sidebar locking the two members from rotation relative to each other, said first sidebar being partly inside a notch in the inner surface of the first member and having a portion of its body located in a passage in the second member, said first sidebar having a set of teeth that can mesh with said teeth on the tumbler, a correct key capable of being inserted into said lock to position the said tumbler so as to permit the said two sets of teeth to mesh so as to permit the first sidebar to move away from the said first member and permit the two members to move relative to each other, a second sidebar with a second set of teeth, said tumbler provided with a second set of teeth, said two second sets of teeth being in mesh with said second sidebar out of said notch in the first member.

9. In a sidebar lock, two major parts, a first sidebar having two possible positions, the first of which positions comprises the sidebar holding the two parts from relative movement, there being a second position permitting relative movement of the two parts so as to open said lock, circular tumblers capable of rolling action relative said first sidebar, a correct key to position said tumbler by rolling it along the sidebar and to permit the sidebar to move into its second position, a second sidebar along which the tumbler can also roll when said tumbler is being positioned by said correct key, means to disengage the second sidebar from the tumbler when the lock is open, means to permit the removal of the first key and the insertion of a second key, and means to re-engage the second sidebar with the tumbler when the lock is being closed by the second key.

* * * * *